US008018391B2

(12) United States Patent
Kaneko et al.

(10) Patent No.: US 8,018,391 B2
(45) Date of Patent: Sep. 13, 2011

(54) PLATE-SHAPED ANTENNA HAVING AT LEAST THREE PLANES

(75) Inventors: Atsushi Kaneko, Saitama (JP); Shuji Hagiwara, Saitama (JP)

(73) Assignee: Yagi Antenna Inc., Saitama (JP)

( * ) Notice: Subject to any disclaimer, the term of this patent is extended or adjusted under 35 U.S.C. 154(b) by 0 days.

(21) Appl. No.: 12/637,035

(22) Filed: Dec. 14, 2009

(65) Prior Publication Data

US 2010/0090919 A1 Apr. 15, 2010

Related U.S. Application Data

(62) Division of application No. 11/994,190, filed as application No. PCT/JP2006/305160 on Mar. 15, 2006.

(30) Foreign Application Priority Data

Jun. 30, 2005 (JP) ..... P.2005-192060
Jul. 5, 2005 (JP) ..... P.2005-196436
Sep. 26, 2005 (JP) ..... P.2005-277923

(51) Int. Cl.
*H01Q 13/10* (2006.01)

(52) U.S. Cl. ..... 343/770

(58) Field of Classification Search ..... 343/803, 343/793, 872, 770–772
See application file for complete search history.

(56) References Cited

U.S. PATENT DOCUMENTS 5,710,569 A 1/1998 Oh et al.
5,717,410 A 2/1998 Ohmine et al.
6,255,994 B1 7/2001 Saito
6,486,843 B2 11/2002 Wang et al.
6,650,301 B1 11/2003 Zimmerman
6,931,165 B2 * 8/2005 Nagaeda et al. ..... 385/11
6,940,469 B2 9/2005 Gottl et al.
7,324,062 B2 1/2008 Noro et al.

FOREIGN PATENT DOCUMENTS

CN 1467874 A 1/2004
JP 7-249922 9/1995
JP 07-249922 A 9/1995
JP 11-163621 6/1999
JP 11-163621 A 6/1999
JP 2001-185944 * 7/2001
JP 2001-185944 A 7/2001

(Continued)

OTHER PUBLICATIONS

Non-Final Office Action issued in related U.S. Appl. No. 11/994,190, dated Mar. 8, 2010.

(Continued)

*Primary Examiner* — Huedung Mancuso
(74) *Attorney, Agent, or Firm* — Sughrue Mion, PLLC

(57) ABSTRACT

A plate-shaped radiating element of a shape having at least three planes is formed by bending a metal plate having a substantially rectangular shape. A first slit is provided from a lower edge of the plate-shaped radiating element up to a portion in the vicinity of an upper edge of the plate-shaped radiating element while passing through a center point of the plate-shaped radiating element, and forms plate-shaped dipole elements on both sides thereof. A second slit is provided parallel to the upper edge of the plate-shaped radiating element and forms a folded element on an upper side thereof. Feeding points are provided on both sides of the first slit at the lower edge of the plate-shaped radiating element.

6 Claims, 21 Drawing Sheets

FOREIGN PATENT DOCUMENTS

| | | | | |
|---|---|---|---|---|
| JP | 2002-064313 | | | 2/2002 |
| JP | 2002-064313 | A | | 2/2002 |
| JP | 2003-69332 | A | | 3/2003 |
| JP | 2003-163533 | | * | 6/2003 |
| JP | 2003-163533 | A | | 6/2003 |
| JP | 2004-023797 | | | 1/2004 |
| JP | 2004-023797 | A | | 1/2004 |
| JP | 2004-140815 | A | | 5/2004 |
| JP | 2004-274655 | | * | 9/2004 |
| JP | 2004-274655 | A | | 9/2004 |
| JP | 2005-013422 | A | | 1/2005 |
| JP | 2005-203829 | | | 7/2005 |
| JP | 2005-203829 | A | | 7/2005 |
| WO | 2005/013422 | | | 2/2005 |

OTHER PUBLICATIONS

Notification of Reason for Refusal dated May 17, 2010, in counterpart Japanese Application No. 2005-277923.

Taiwanese Office Action dated May 17, 2010, in counterpart Taiwanese Application No. 095108698.

Japanese Office Action dated Dec. 15, 2009.

Shimizu, et al.; "A Study on Broadband Planar Anenna", Heimen Kozo no Kotaiiki Antenna no Kenkyu; The Institute of Electronics, Information and Communication Engineers, Technical Report of IEICE; vol. 104. No. 203; Jul. 23, 2004; Full Text, Figs. 7-10.

U.S. Office Action issued in U.S. Appl. No. 11/994,190 dated Aug. 20, 2010 (14 pages).

Japanese Office Action dated Dec. 15, 2008.

Japanese Office Action issued on Aug. 10, 2010 in the corresponding Japanese Patent Application No. 2005-277923.

Chinese Office Action issued in Chinese Application No. 200680024016.X dated Feb. 24, 2011 (5 pages).

United States Office Action, dated Feb. 10, 2011, issued in related U.S. Appl. No. 11/994,190.

Shimizu et al; "A Study on Broadband Planar Antenna"; The Institute of Electronics, Information and Communication Engineers, Technical Report of IEICE; vol. 104, No. 203, Jul. 23, 2004.

* cited by examiner

PLATE-SHAPED ANTENNA HAVING AT LEAST THREE PLANES

CROSS REFERENCE TO RELATED APPLICATION

This application is a divisional of U.S. patent application Ser. No. 11/994,190, filed Dec. 28, 2007, which is a national stage of PCT Application No. PCT/JP2006/305160, filed on Mar. 15, 2006, the entire disclosure of which is incorporated by reference.

BACKGROUND OF THE INVENTION

1. Field of the Invention

The present invention is related to an antenna, for instance, an indoor-purpose antenna and an outdoor-purpose antenna, which are used so as to receive and communicate terrestrial integrated services digital broadcasting waves in the UHF frequency band.

2. Background

In the ISTB-T (Terrestrial Integrated Services Digital Broadcasting) system, electromagnetic waves of the UHF frequency band are utilized, and in this UHF frequency band, 470 to 770 MHz (13 to 62 channels) are used.

As indoor-purpose antennas which receive electromagnetic waves of the UHF frequency band, loop antennas and dipole antennas have been employed (refer to, for example, JP-A-7-249922). The dipole antennas are constituted by conductive pipes, while broadband characteristics and high gain characteristics of the dipole antennas are known in the field. However, entire lengths of these dipole antennas require approximately 0.5λ (wavelength) of lower end frequencies, and radiation characteristics thereof are a single directivity characteristic.

Also, as outdoor-purpose antennas which receive electromagnetic waves of the UHF band, single directivity antennas have been used which are typically known as Yagi type antennas and reflector-equipped dipole antennas, while these single directivity antennas represent superior reception performance with respect to receptions of a specific direction. However, since the outdoor-purpose antennas require large occupied areas and also have the single directivity characteristic, in such a case that directions of traveling electromagnetic waves are different from each other depending upon broadcasting stations, the outdoor-purpose antennas are required to be separately installed toward the respective directions of the traveling electromagnetic waves.

FIG. 14 represents an example of such a case that two pieces of Yagi-type antennas have been installed in correspondence with electromagnetic waves whose traveling directions are different from each other.

The Yagi-type antennas 1*a* and 1*b* for horizontally polarized waves are mounted on a summit portion of an antenna mast 2 and are separated in a predetermined interval. In this case, two pieces of the Yagi-type antennas 1*a* and 1*b* are set to be directed toward the traveling directions of the electromagnetic waves. Power feeding cables 4*a* and 4*b* are connected to feeding points 3*a* and 3*b* of the Yagi-type antennas 1*a* and 1*b* respectively. The power feeding cables 4*a* and 4*b* are held along the antenna mast 2, and are connected to a mixer 5 which is mounted on a half way of this antenna mast 2. In this mixer 5, signals received by the Yagi-type antennas 1*a* and 1*b* are mixed with each other, and then, the mixed signal is supplied to a TV receiver set in a home through an output cable 6. It should be understood that a holding member 7 is mounted on a base of the antenna mast 2, while the holding member 7 is employed so as to fix this antenna mast 2 on, for example, a roof.

As previously described, in such a case that electric magnetic waves whose traveling directions are different from each other depending upon broadcasting stations are received by employing single directivity antennas, a plurality of such single directivity antennas must be installed, and thus, antenna constructions are very cumbersome, for instance, mixers are installed, and cable wirings become complex.

Also, in the above-described UHF-band broadband antennas, since upper projection areas are large, snow may be easily accumulated thereon, and thus, strengths of the antennas themselves must be increased in order to endure electric influences caused by the accumulations of snow and weights given by the accumulated snow.

Also, since the above-described Yagi-type antennas have the single directivity characteristics, in such a case that traveling directions of electromagnetic waves are different from each other depending upon broadcasting stations, the plurality of these antennas are required to be separately installed toward the respective traveling directions of the electromagnetic waves. Accordingly, there is such a problem that installation places are limited, and further, installation costs are increased.

Also, in order to simply install antennas, indoor-purpose antennas have been commercially provided in markets. Similarly, since these indoor-purpose antennas have directivity, the antenna main bodies must be rotated and be adjusted in order to achieve better reception conditions thereof. A lengthy time is required to seek best receiving conditions. Then, in such a case that indoor-purpose antennas are installed beside television receivers, best reception directions of these indoor purpose antennas are not always made coincident with the directions of the television receivers, which may largely damage good appearances. Moreover, antennas having single directivity characteristics have such a problem that if a subject having a certain dielectric constant, for instance, a person approaches the antennas, then reception levels thereof are largely lowered.

An object of the present invention is to provide an indoor and outdoor commonly-used antenna which can be made compact with a simple structure, can be easily installed even in a narrow installation space, and can be operated by a single piece of antenna even in such a case that electromagnetic waves are traveled from a plurality of directions, and further, which can be utilized for an indoor-purpose antenna as well as an outdoor-purpose antenna.

SUMMARY OF THE INVENTION

In order to achieve the above-described object, according to the present invention, there is provided an antenna, comprising:

a plate-shaped radiating element, formed by bending a metal plate having a substantially rectangular shape so as to have a shape having at least three planes;

a first slit, provided from a lower edge of the plate-shaped radiating element up to a portion in the vicinity of an upper edge of the plate-shaped radiating element while passing through a center point of the plate-shaped radiating element, and forming plate-shaped dipole elements on both sides thereof;

a second slit, provided parallel to the upper edge of the plate-shaped radiating element, and forming a folded element on an upper side thereof; and feeding points, provided on both sides of the first slit at the lower edge of the plate-shaped radiating element.

In order to achieve the above-described object, according to the present invention, there is also provided an antenna, comprising:

a plate-shaped radiating element, formed by bending a metal plate having a substantially rectangular shape so as to have a shape having at least three planes;

a first slit, provided from a portion in the vicinity of a lower edge of the plate-shaped radiating element up to a portion in the vicinity of an upper edge of the plate-shaped radiating element while passing through a center point of the plate-shaped radiating element, and forming plate-shaped dipole elements on both sides thereof;

a second slit, provided parallel to the upper edge of the plate-shaped radiating element, and forming a first folded element on an upper side thereof;

a third slit, provided parallel to the lower edge of the plate-shaped radiating element, and forming a second folded element on a lower side thereof;

a fourth slit, provided parallel to the upper edge of the plate-shaped radiating element from a left edge of the plate-shaped radiating element up to a portion in the vicinity of the center point;

a fifth slit, provided parallel to the upper edge of the plate-shaped radiating element from a right edge of the plate-shaped radiating element up to a portion in the vicinity of the center point; and feeding points, provided between the first slit and the fourth slit, and between the first slit and the fifth slit.

In order to achieve the above-described object, according to the present invention, there is also provided an antenna, comprising:

a plate-shaped radiating element, formed by bending a metal plate having a substantially rectangular shape so as to have a shape having at least three planes;

a first slit, provided from a portion in the vicinity of a lower edge of the plate-shaped radiating element up to a portion in the vicinity of an upper edge of the plate-shaped radiating element while passing through a center point of the plate-shaped radiating element, and forming plate-shaped dipole elements on both sides thereof;

a second slit, provided parallel to the upper edge of the plate-shaped radiating element, and forming a first folded element on an upper side thereof;

a third slit, provided parallel to the lower edge of the plate-shaped radiating element, and forming a second folded element on a lower side thereof; and feeding points, provided on both sides of the first slit at the lower edge of the plate-shaped radiating element.

In order to achieve the above-described object, according to the present invention, there is also provided an antenna, comprising:

an antenna member, comprised of a plate-shaped radiating element which is formed by bending a metal plate having a substantially rectangular shape so as to have a shape having at least three planes, or a circular shape, the antenna member operable to receive electromagnetic waves; and a cover, adapted to cover the antenna member; wherein:

a length of the cover on a side of an intersecting polarization plane is longer than a length of the cover on a side of a polarization plane.

The antenna may further comprise a base to be attached to the cover.

The antenna may further comprise an output member, operable to output a signal based on the electromagnetic waves received by the antenna member.

The antenna may further comprise an outdoor setting-purpose attaching member which is attached to the cover.

The antenna may further comprise a supporting member, integrally or detachably provided with the cover, and selectively attachable to one of an indoor setting-purpose base and an outdoor setting-purpose attaching member.

In accordance with the present invention, since the plate-shaped radiating element is used so as to form a non-directional antenna, while the plate-shaped radiating element is formed by bending the metal plate having the substantially rectangular shape in either a polygonal shape larger than, or equal to a quadrangle shape or a circular shape, the shape of the cover for the antenna can be made of a cylindrical shape whose length on the side of the polarization plane is shorter than the length thereof on the side of the intersecting polarization plane. As a result, the installation space in the case that the antenna is used as the indoor-purpose antenna can be very small, as compared with that for the conventional indoor-purpose antenna, so that the freedom degree of the antenna installation is large, and the antenna can be easily set even in a narrow place.

Also, since the directivity of the horizontal plane is an omnidirectional characteristic, it is no longer to rotate the antenna so as to adjust the reception characteristic, so that the adjusting time can be largely reduced. Also, since the antenna characteristic is designed as the omnidirectional characteristic, the antenna can easily receive reflected waves, and even when the direct wave direction of the antenna is shielded, since the antenna receives the reflected waves, it is possible to avoid lowering of the reception level.

Furthermore, in such a case that the indoor-purpose antenna is installed beside a television receiver, the antenna can achieve the reception performance which is not influenced by the electromagnetic wave environment; the direction of the television receiver can be made coincident with the direction of the antenna, so that the good appearance thereof can be maintained. Moreover, a change in the directivity occurred when a person approaches the antenna can be decreased, so that the lowering amount of the reception level can be reduced, as compared with that of the conventional antenna having the single directivity characteristic.

BRIEF DESCRIPTION OF THE DRAWINGS

FIG. 1C being a sectional view.

DETAILED DESCRIPTION OF THE INVENTION

Referring now to drawings, a description is made of embodiment modes of the present invention.

It should be understood that the below-mentioned descriptions of present embodiment modes are made based upon such an initial condition that electromagnetic waves transmitted by in the form of horizontally polarized waves are received. In this case, a polarization plane of the electromagnetic waves constitute a plane located parallel to the ground, and another plane which is intersected with the polarization plane at a right angle corresponds to an intersected polarization plane. When an antenna is set, a direction of the antenna is required to be made coincident with a polarization plane of received electromagnetic waves. In the case that the inventive idea of the present invention is applied to a reception of electromagnetic waves transmitted in the form of vertically polarized waves, since a polarization plane of the electromagnetic waves constitutes a plane located perpendicular to the ground, the antenna of the present embodiment mode may be inclined by 90 degrees so as to be made coincident with the polarization plane to be received.

First Embodiment Mode

Figure 1A:
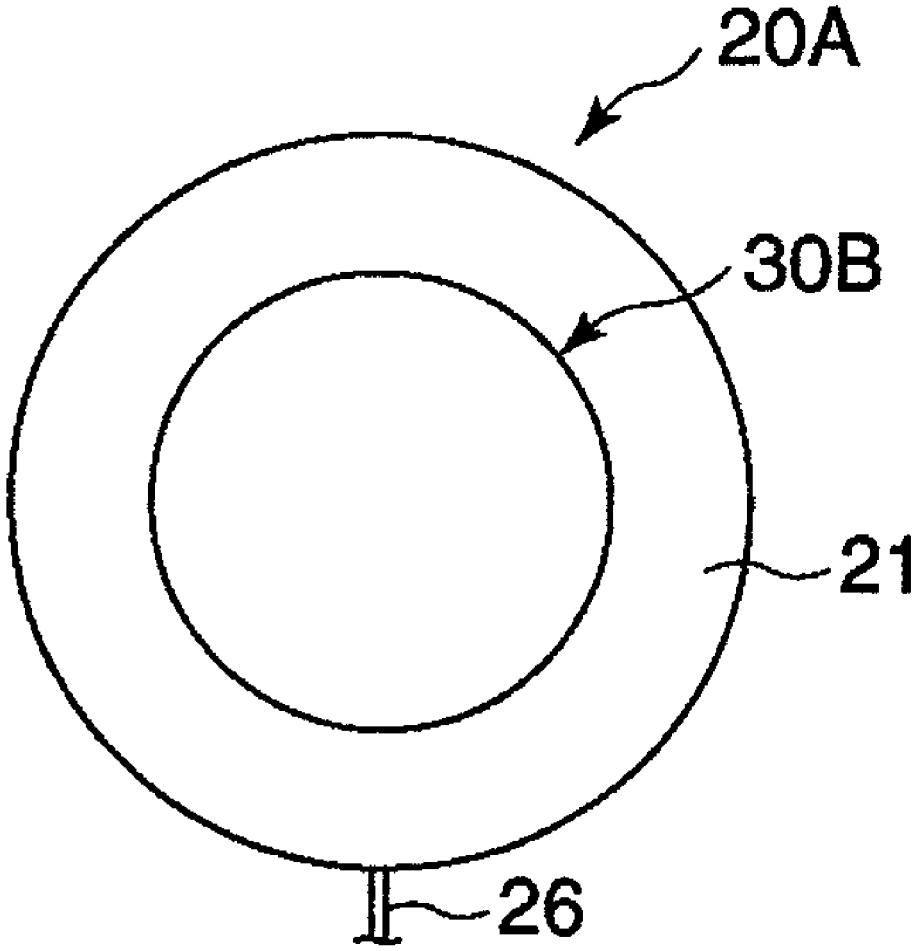
FIG. 1A to FIG. 1C show an indoor-purpose antenna according to a first embodiment mode of the present invention, FIG. 1A being a plan view, FIG. 1B being a front view.
Figure 1B:
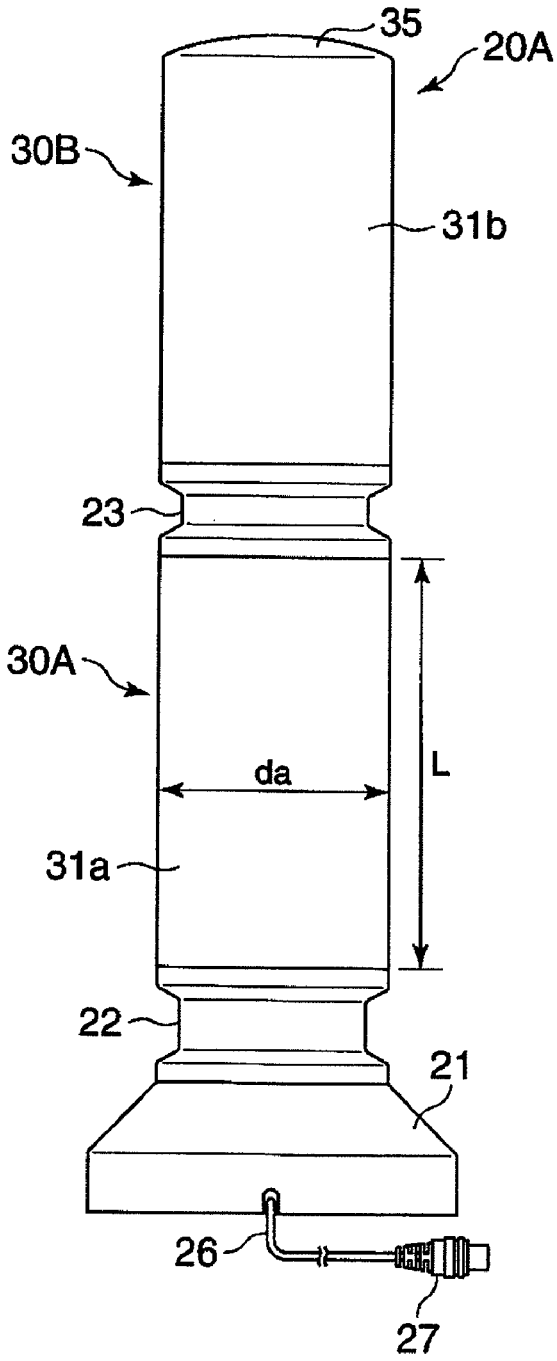
Figure 1C:
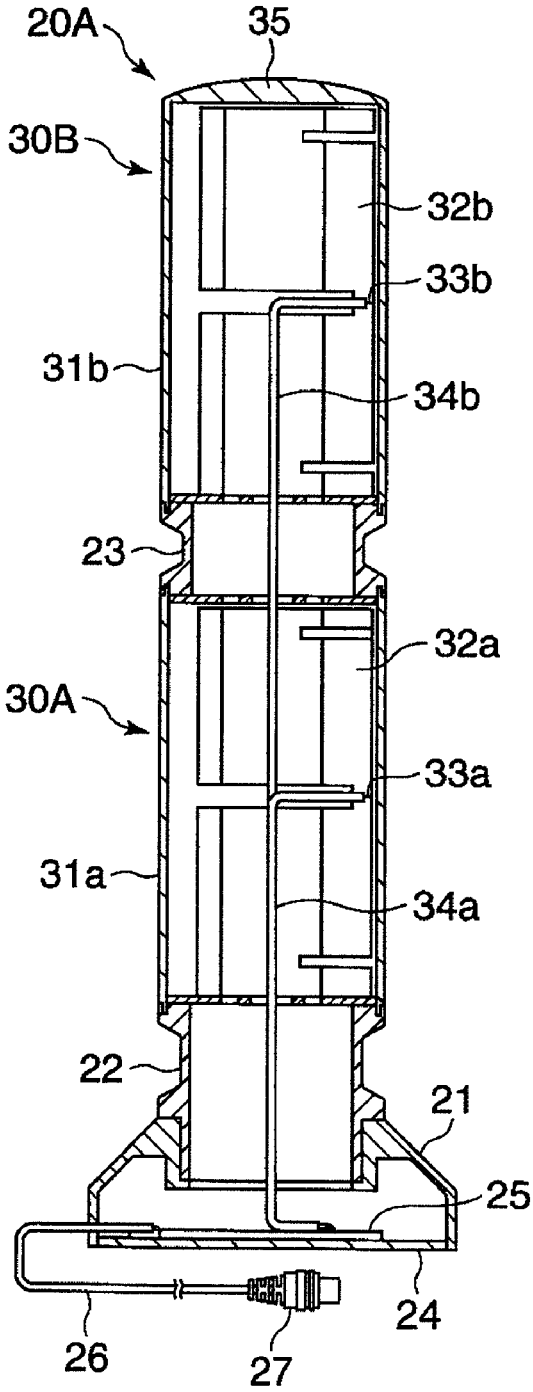

In an indoor antenna 20A shown in FIG. 1A to FIG. 1C, reference numeral 21 indicates a base which is made of, for example, a synthetic resin and is formed in, for instance, a circular shape. A first antenna main body 30A is mounted via a supporting cylinder 22 on the base 21, and a second antenna main body 30B is mounted via another supporting cylinder 23 on the first antenna main body 30A.

A diameter of the base 21 is set to approximately 0.22λ (=about 140 mm). A bottom plate 24 is detachably provided on the base 21 by employing, for instance, screws, into which a mixing board 25 is arranged. A mixing circuit for mixing a reception signal of the first antenna main body 30A with another reception signal of the second antenna main body 30B is provided on the mixing board 25. A mixed output of this mixing circuit is conducted via an output cable 26 to an external portion of the base 21. An output-purpose connecting stopper 27 is attached to a tip portion of the output cable 26. This output-purpose connecting stopper 27 is connected to an antenna terminal of a television receiver (not shown) installed in a home.

The first antenna main body 30A includes an antenna cover 31*a* formed in a cylindrical shape by employing a synthetic resin, and a broadband antenna 32*a* which is provided in this antenna cover 31*a*. The antenna cover 31*a* is mounted on an upper portion of the supporting cylinder 22. A feeding point 33*a* of the broadband antenna 32*a* is connected via a feeding cable 34*a* to the mixing board 25 provided in the base 21, while the feeding cable 34*a* is connected to the mixing board 25 by a soldering treatment, or the like.

As will be explained later in detail, the above-described broadband antenna 32*a* is constructed by employing a non-directional (omnidirectional) plate-shaped radiating element so as to receive TV broadcasting waves of the UHF frequency band. The non-directional plate-shaped radiating element is formed by bending, for instance, a metal plate having a substantially rectangular shape to have a polygonal shape (namely, shape having at least 3 planes) larger than, or equal to a quadrangle shape, or a circular shape.

Also, similar to the first antenna main body 30A, the second antenna main body 30B includes an antenna cover 31*b* formed in a cylindrical shape by employing a synthetic resin, and a broadband antenna 32*b* which is provided in this antenna cover 31*b*. The antenna cover 31*b* is mounted via the supporting cylinder 23 on the antenna cover 31*a* of the first antenna main body 30A. A feeding cable 34*b* is connected to a feeding point 33*b* of the broadband antenna 32*b*. The feeding cable 34*b* passes through a center portion of the first antenna main body 30A, and then, is connected to the mixing board 25 provided in the base 21. Also, a lid 35 is provided on an upper opening portion of the antenna cover 31*b* in a fixing manner, or in a detachable manner. As will be discussed later in detail, as to the broadband antennas 32*a* and 32*b*, maximum lengths of polarization planes thereof are set to approximately 0.16λ. It should be noted that symbol "λ" indicates a wavelength of a lower end frequency in a frequency band under use.

Lengths (namely, lengths projected along electric field directions) "da" of the antenna covers 31*a* and 31*b* on the side of polarization planes, in this example, diameters of these antenna covers 31*a* and 31*b* are set to be slightly longer than the maximum lengths (0.16λ) of the polarization planes of the broadband antennas 32*a* and 32*b*, namely, set to for instance, approximately 0.17λ. Also, lengths "L" of the antenna covers 31*a* and 31*b*, namely lengths thereof on the side of the intersected polarization plane are set to longer lengths than the lengths "da" thereof on the side of the polarization planes.

As previously described, in the antenna main bodies 30A and 30B, since the metal plates having the substantially rectangular shapes are bent in the form of the polygonal shapes (shapes each having at least 3 planes) higher than, or equal to the quadrangle shapes so as to form the broadband antennas 32*a* and 32*b*, the lengths "da" of the antenna covers 31*a* and 31*b* are set to approximately 0.17λ, and thus, can be made shorter than the lengths "L" thereof on the side of the intersected polarization plane, and the diameter of the base 21 can be set to approximately 0.22λ (approximately 140 mm). As a consequence, the occupied area of the antenna can be made considerably small, as compared with that of the relevant broadband antenna, so that the antenna can be installed in the narrow space.

It should also be noted that although the above-described first embodiment mode is exemplified such a case that the antenna covers 31*a* and 31*b* are made in the cylindrical shapes, these antenna covers 31*a* and 31*b* may be made in, for example, such polygonal shapes as hexagons and octagons, or other shapes such as a conical shape and a multi-pyramids shape.

Second Embodiment Mode

Figure 2A:
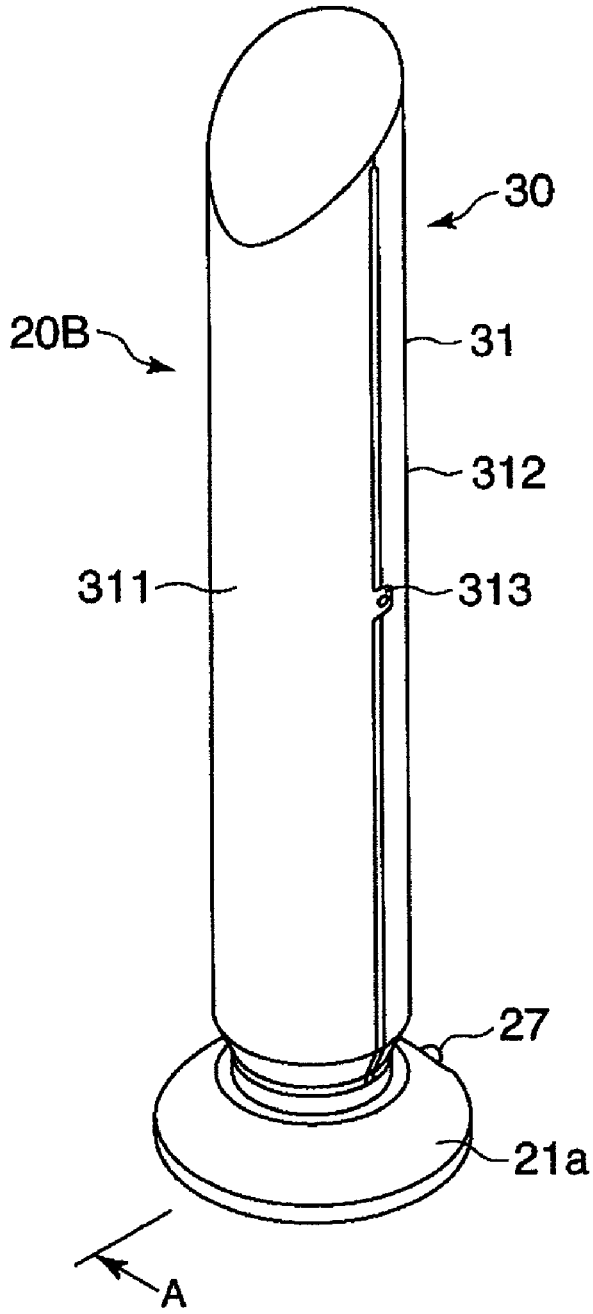
FIG. 2A and FIG. 2B indicate an indoor-purpose antenna according to a second embodiment mode of the present invention, and FIG. 2A being a perspective view and FIG. 2B being a partially sectional view.
Figure 2B:
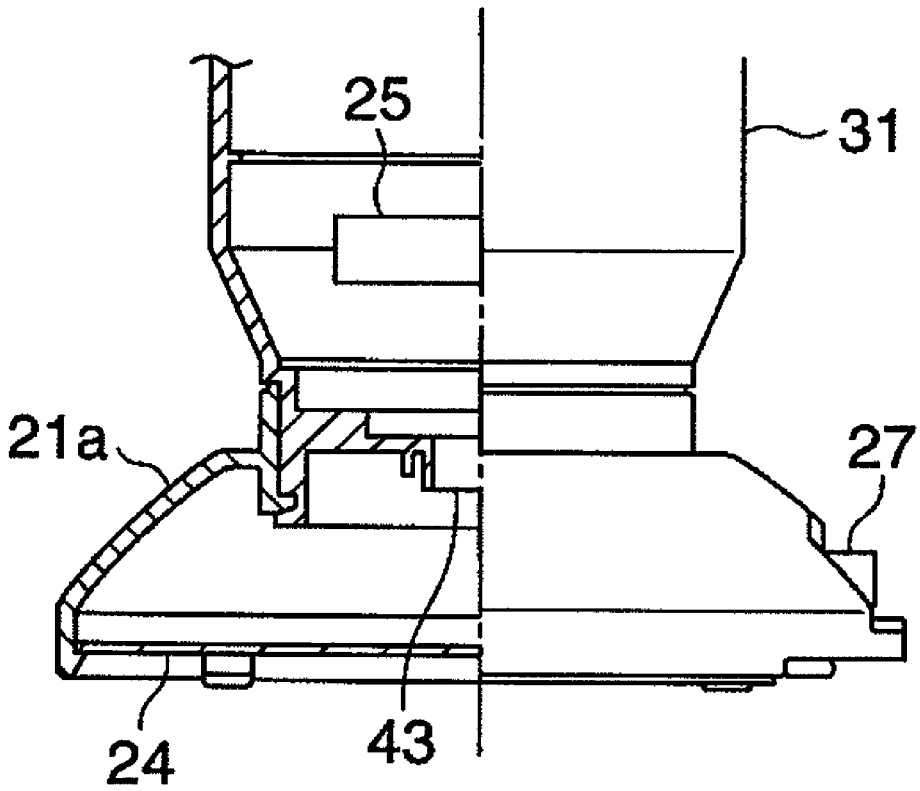

The above-described first embodiment mode is described such a case that while the antenna covers 31*a* and 31*b* are separately provided with respect to the first antenna main body 30A and the second antenna main body 30B, these antenna covers 31*a* and 31*b* are coupled to each other by employing the supporting cylinder 23. In a second embodiment mode of the present invention shown in FIG. 2A and FIG. 2B, an antenna main body 30 is protected by a single antenna cover 31. This antenna cover 31 is fixed by a screw 313 at a center portion thereof, while cover elements 311 and 312 formed in, for example, semi-cylindrical shapes are joined to each other. Also, the antenna cover 31 is formed by inclining an upper edge unit.

While a lower edge portion of the antenna cover 31 is made in a small diameter, the antenna main body 30 is detachably provided on a base 21*a*. It should also be noted that in the second embodiment mode, the mixing board 25 is provided on the side of the antenna main body 30, and a connecting stopper 43 is provided at a lower edge portion (below portion of mixing board 25) of the antenna main body 30. Also, the output-purpose connecting stopper 27 is directly attached to the base 21*a*.

The broadband antennas 32*a* and 32*b* represented in the first embodiment mode are provided inside the antenna cover 31, and a feeding point thereof is connected via a power feeding cable (not shown) to the mixing circuit of the mixing board 25. Then, a signal mixed by this mixing circuit is transferred from the connecting stopper 43 via the power feeding cable to the output-purpose connecting stopper 27. Since other structures of the indoor antenna 20B are similar to the structures of the indoor antenna 20A indicated in the first embodiment mode, detailed explanations thereof will be omitted.

The indoor antenna 20B constructed in the above-described manner can achieve a similar effect to that of the indoor antenna 20A according to the first embodiment mode.

Third Embodiment Mode

Figure 3:
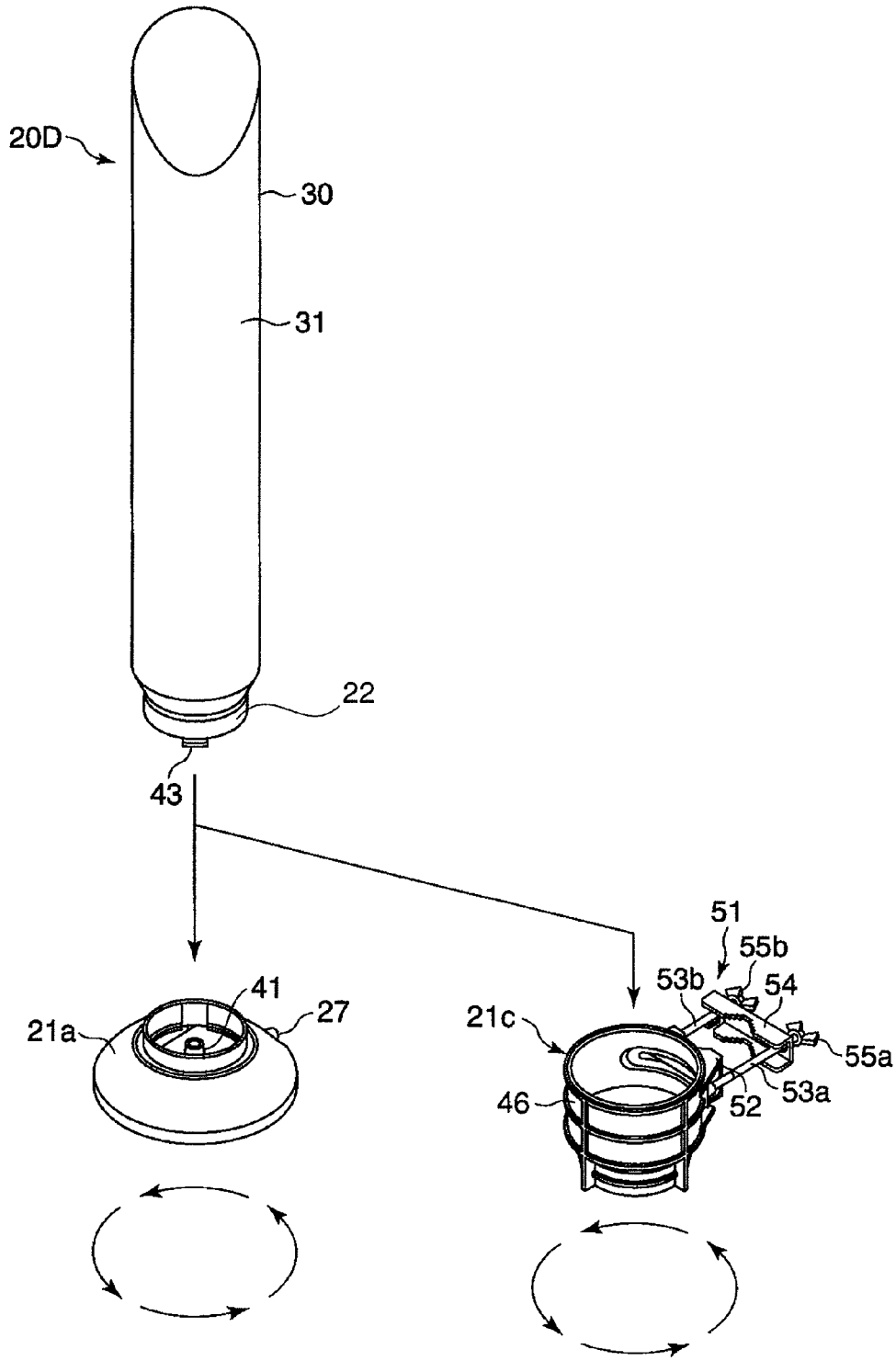
FIG. 3 is an exploded perspective view of an indoor and outdoor commonly-used antenna according to a third embodiment mode of the present invention.
Figure 4A:
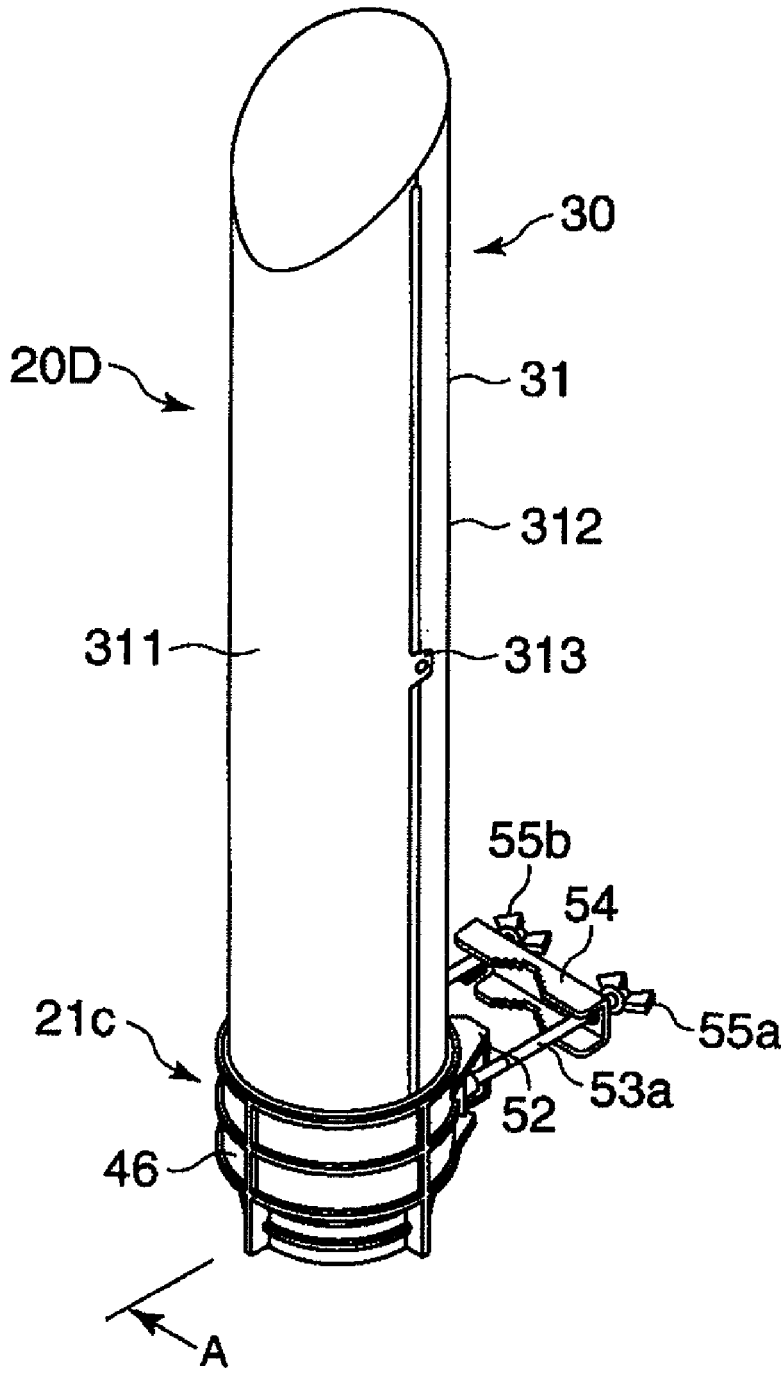
FIG. 4A and FIG. 4B show such a case that the indoor and outdoor commonly-used antenna according to the third embodiment mode is used as an outdoor-purpose antenna, FIG. 4A being a perspective view and FIG. 4B being a partially sectional view.
Figure 4B:
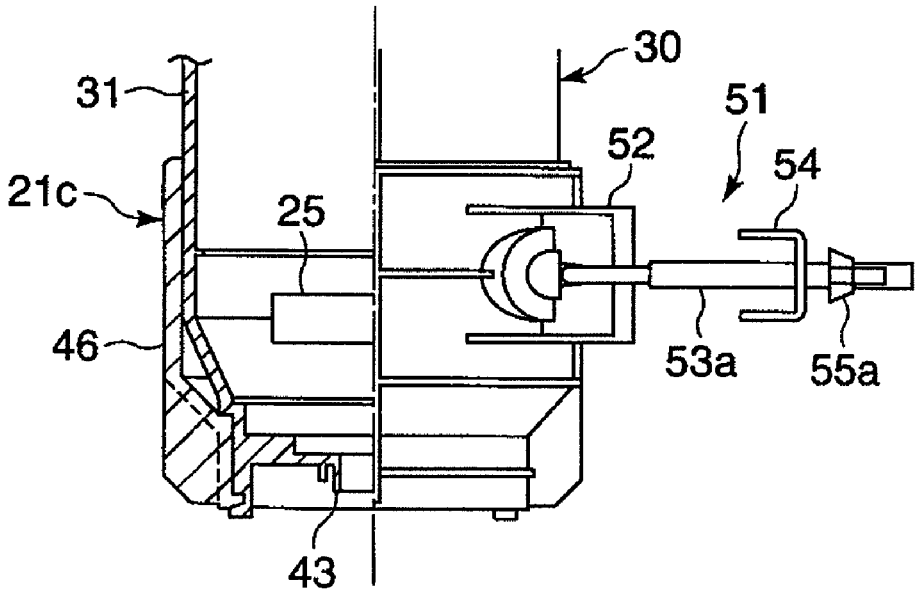

A third embodiment mode of the present invention shown in FIG. 3, FIG. 4A, and FIG. 4B constitutes an indoor and outdoor commonly-used antenna 20D by utilizing the antenna main body 30 represented in the second embodiment mode. In this indoor and outdoor commonly-used antenna 20D, an indoor setting-purpose base 21*a* and an outdoor setting-purpose base 21*c* are detachably are provided with respect to the antenna main body 30. For instance, while a structure between the antenna main body 30 and the bases 21*a*, 21*c* is formed as a locking type structure, the indoor setting-purpose base 21*a* and the outdoor setting-purpose base 21*c* are pivotably rotated at a predetermined angle so as to be detachably attached to the antenna main body 30.

Then, a connecting stopper 43 is provided at a center of the lower edge portion of the antenna main body 30, another connecting stopper 41 is provided at an inside center of the base 21*a*, and when the antenna main body 30 is mounted on the base 21*a*, the connecting stopper 43 is connected to the connecting stopper 41. This connecting stopper 41 is connected via a power feeding cable to the output-purpose connecting stopper 27.

Also, while the outdoor setting-purpose base 21*c* is constituted by a cylindrical member 46, an outdoor-purpose fitting member 51 is attached to the outer side of this cylindrical member 46. In the outdoor-purpose fitting member 51, rod-shaped mounting members 53*a* and 53*b* are provided on both sides of a mounting base 52 in a fixing manner, and screw portions are formed at tip portions of the mounting members 53*a* and 53*b*. For instance, butterfly type nuts 55*a* and 55*b* are screwed via a depression fitting member 54 on the tip portions of the mounting members 53*a* and 53*b*. The mounting base 52 is fixed on the supporting cylinder 22 by a bolt.

The outdoor-purpose fitting member 51 can mount the indoor and outdoor commonly-used antenna 20D in the outdoor space by interposing either an antenna mast or a pole of a veranda fixing member between the mounting base 52 and the depression fitting member 54 and by fastening the nuts 55*a* and 55*b*.

FIG. 4A shows such a condition that the outdoor setting-purpose base 21*c* is attached to the antenna main body 30, and FIG. 4B is a sectional view for indicating a portion to which the base 21*c* is attached. While a lower side of the outdoor setting-purpose base 21*c* is opened, when the base 21*c* is attached to the antenna main body 30, the connecting stopper 43 provided at the lower edge portion of the antenna main body 30 is positioned at the low opening portion of the base 21*c*. As a consequence, at this opening portion, an external connection-purpose coaxial cable can be connected to the connecting stopper 43.

In the case that the indoor and outdoor commonly-used antenna 20D constructed in the above-described manner is used as an indoor antenna, the indoor setting-purpose base 21*a* is attached to the antenna main body 30, and also, in the case that the indoor and outdoor commonly-used antenna 20D constructed in the above-described manner is used as an outdoor antenna, the outdoor setting-purpose base 21*c* is attached to the antenna main body 30, and then, the indoor and outdoor commonly-used antenna 20D is mounted on either the antenna mast or the pole of the veranda fitting member by employing the outdoor-purpose mounting member 51.

Next, a description is made of structural examples as to the broadband antennas 32*a* and 32*b* of the antenna main bodies 30A and 30B according to the above-described first, second, and third embodiment modes.

First Structural Example

In a broadband antenna 32-1 shown in FIG. 5A to FIG. 5C and FIG. 6, reference numeral 61 shows a plate-shaped radiating element which is made of, for example, a metal plate having a substantially rectangular shape, while this plate-shaped radiating element is formed by bending the metal plate in a substantially quadrangle shape, for example a "U-shaped" form.

As to a thickness of the metal plate, for instance, such a metal plate having a thickness smaller than, or equal to approximately 0.002λ is used. As to the plate-shaped radiating element 61, a first slit 62 is vertically provided at a center portion of the plate-shaped radiating element 61 from a lower side thereof up to a position near an upper side thereof, and plate-shaped dipole antennas 63*a* and 63*b* are formed on a left side and a right side of the first slit 62. Also, a second slit 64 is provided in the plate-shaped radiating element 61 from a position in the vicinity of a left edge of the plate-shaped radiating element 61 up to a position in the vicinity of a right edge thereof, and is positioned parallel to an upper edge thereof, while a folded element 65 is formed on an upper portion thereof.

The plate-shaped radiating element 61 is set as follows: That is, for instance, an entire length (lateral width) "L" of the plate-shaped radiating element 61 is set to approximately 0.35λ; a width "L1" of a front plane thereof and a width "L2" of a side plane thereof are set to approximately 0.12λ; a height "H" thereof is set to be longer than, or approximately 0.05λ; and an interval "D1" of the first slit 62 and an interval "D2" of the second slit 64 are set to approximately 0.01λ. As previously described, symbol "λ" shows a wavelength of a lower end frequency in the use frequency band. Also, as to the second slit 64, a length "L3" thereof on the side plane of the plate-shaped radiating element 61 is set to approximately 0.09λ. In the plate-shaped radiating element 61, since the width L1 thereof on the front plane and the width L2 thereof on the side plane are approximately 0.12λ, a maximum length (length of diagonal of element) in the polarization plane is approximately 0.16λ.

Also, power feeding-purpose projection portions 66*a* and 66*b* are formed on the dipole elements 63*a* and 63*b* which are made by that opposite side portions thereof (namely, lower edge portions on the side of first slit 62) are downwardly projected by a predetermined length. A feeding point 67*a* and another feeding point 67*b* are provided at the power feeding-purpose projection portions 66*a* and 66*b*.

Figure 5A:
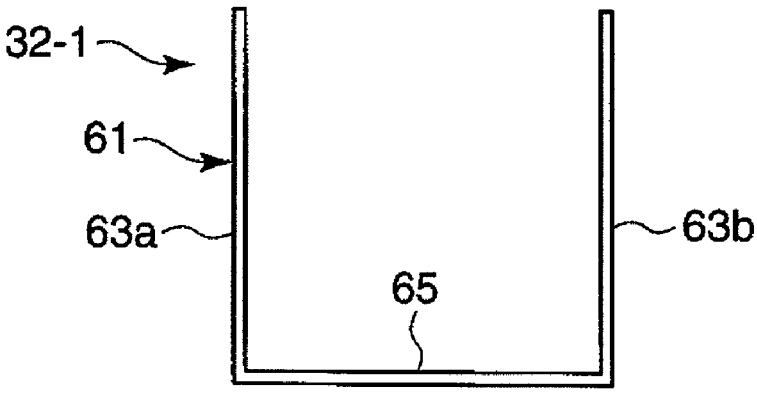
FIG. 5A to FIG. 5C indicate a first structural example of a broadband antenna used in the above-described respective embodiment modes, FIG. 5A being a plan view, FIG. 5B being a front view, and FIG. 5C being a side view.
Figure 5B:
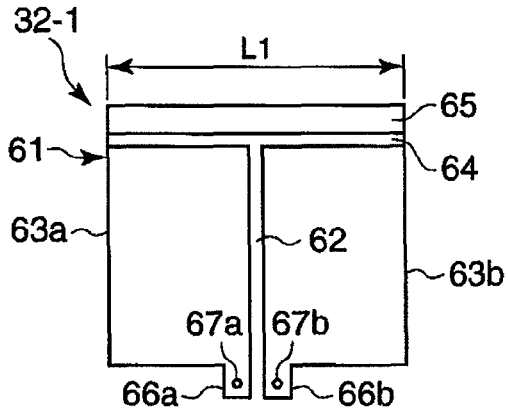
Figure 5C:
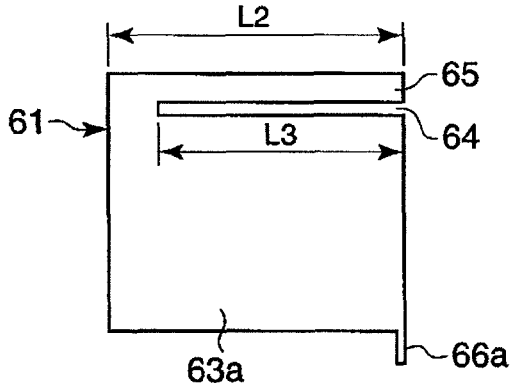
Figure 6:
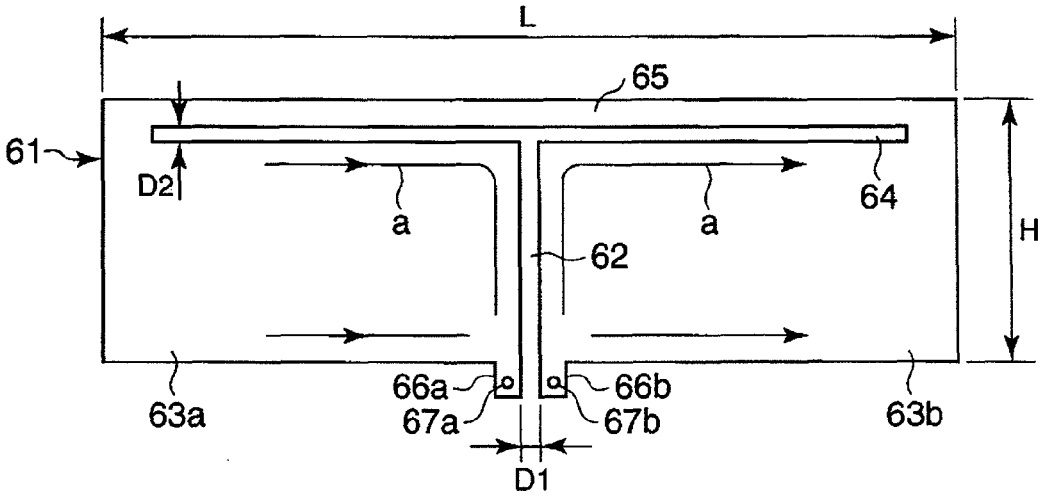
FIG. 6 is a front view for indicating that the broadband antenna shown in FIG. 5A to FIG. 5C is expanded in a plane form.

In the broadband antenna 32-1 indicated in FIG. 5A to FIG. 5C and FIG. 6, when electric power is supplied from a power feeding portion to the feeding points 67*a* and 67*b* of the dipole elements 63*a* and 63*b*, as represented by an arrow "a" in FIG. 6, feeding currents flow from the feeding points 67*a* and 67*b* along the circumferential edges of the dipole elements 63*a* and 63*b*, so that a similar operation to that of a two-wire type folded dipole is preformed. As a result, the broadband antenna 32-1 can achieve a similar effect to that of the two-wire type folded dipole, can be operated over the wide band, and further, can correct an impedance thereof. As a result, while the antenna 32-1 can be made compact, a superior VSWR (voltage standing-wave ratio) characteristic can be realized.

Second Structural Example

Figure 7A:
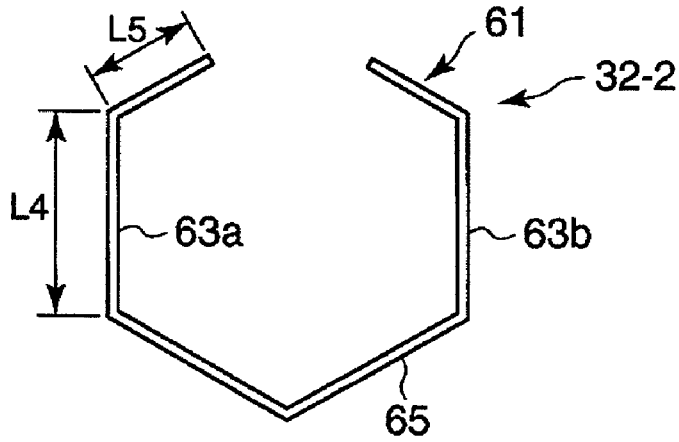
FIG. 7A to FIG. 7C indicate a second structural example of a broadband antenna used in the above-described respective embodiment modes, FIG. 7A being a plan view, FIG. 7B being a front view, and FIG. 7C being a side view.
Figure 7B:
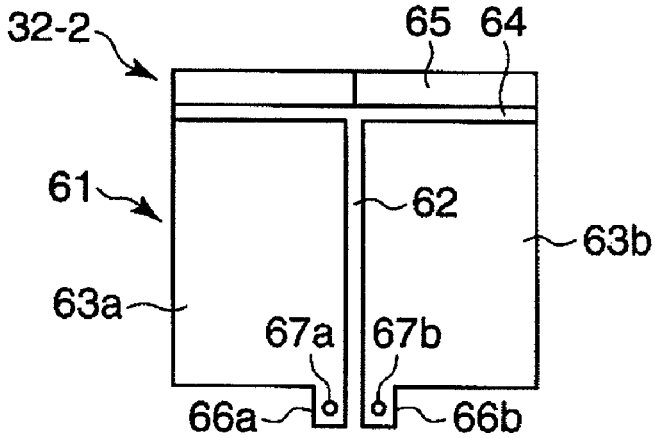
Figure 7C:
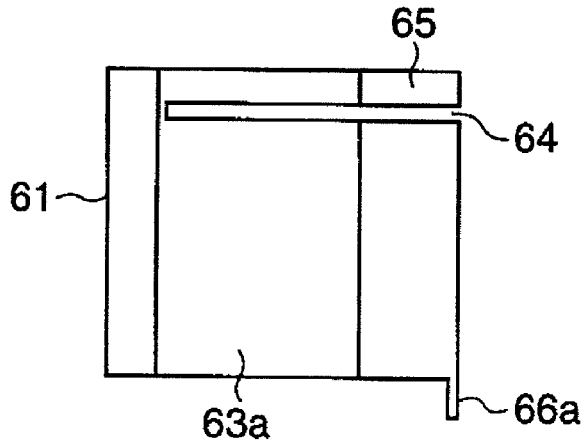

The broadband antenna 32-1 related to the above-described first structural example is formed by bending the plate-shaped radiating element 61 in the "U-shaped" form, whereas a broadband antenna 32-2 related to a second structural example and shown in FIG. 7A to FIG. 7C is formed by bending the plate-shaped radiating element 61 in a substantially hexagonal shape. In this case, a width "L4" of respective edges of the plate-shaped radiating element 61 is set to approximately 0.07λ, and a width "L5" of an edge located on the side of a rear plane is set to approximately 0.03λ and also, tip portions of the dipole elements 63*a* and 63*b* are provided in a predetermined interval, namely, edge portions on the side of the rear planes are separated in the predetermined interval. Since other structures and dimensions of this broadband antenna 32-2 are similar to those of the antenna shown in FIG. 5A to FIG. 5C, detailed explanations thereof will be omitted.

As previously described, since the plate-shaped radiating element 61 is bent in the substantially hexagonal shape so as to form the broadband antenna 32-2, deviation of directivity can be decreased, as compared with that of such a case that the plate-shaped radiating element 61 is bent in the "U-shaped" form so as to form the broadband antenna 32-1.

It should also be noted that FIG. 7A to FIG. 7C have indicated such a case that the plate-shaped radiating element 61 is bent in the substantially hexagonal shape so as to form the broadband antenna 32-2. Alternatively, the plate-shaped radiating element 61 may be formed in a polygonal shape such as an octagonal shape, or in a circular shape.

Third Structural Example

Figure 8A:
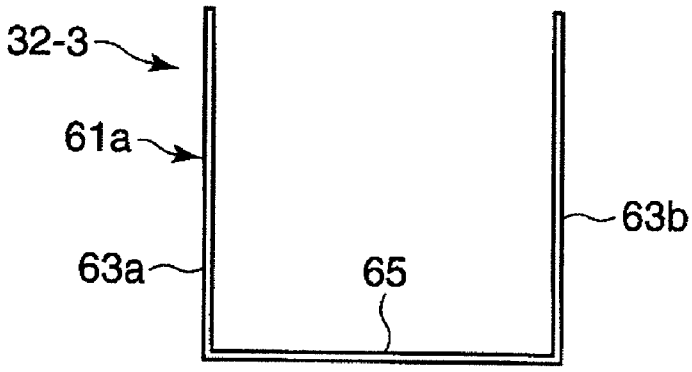
FIG. 8A to FIG. 8C indicate a third structural example of a broadband antenna used in the above-described respective embodiment modes, FIG. 8A being a plan view, FIG. 8B being a front view, and FIG. 8C being a side view.
Figure 8B:
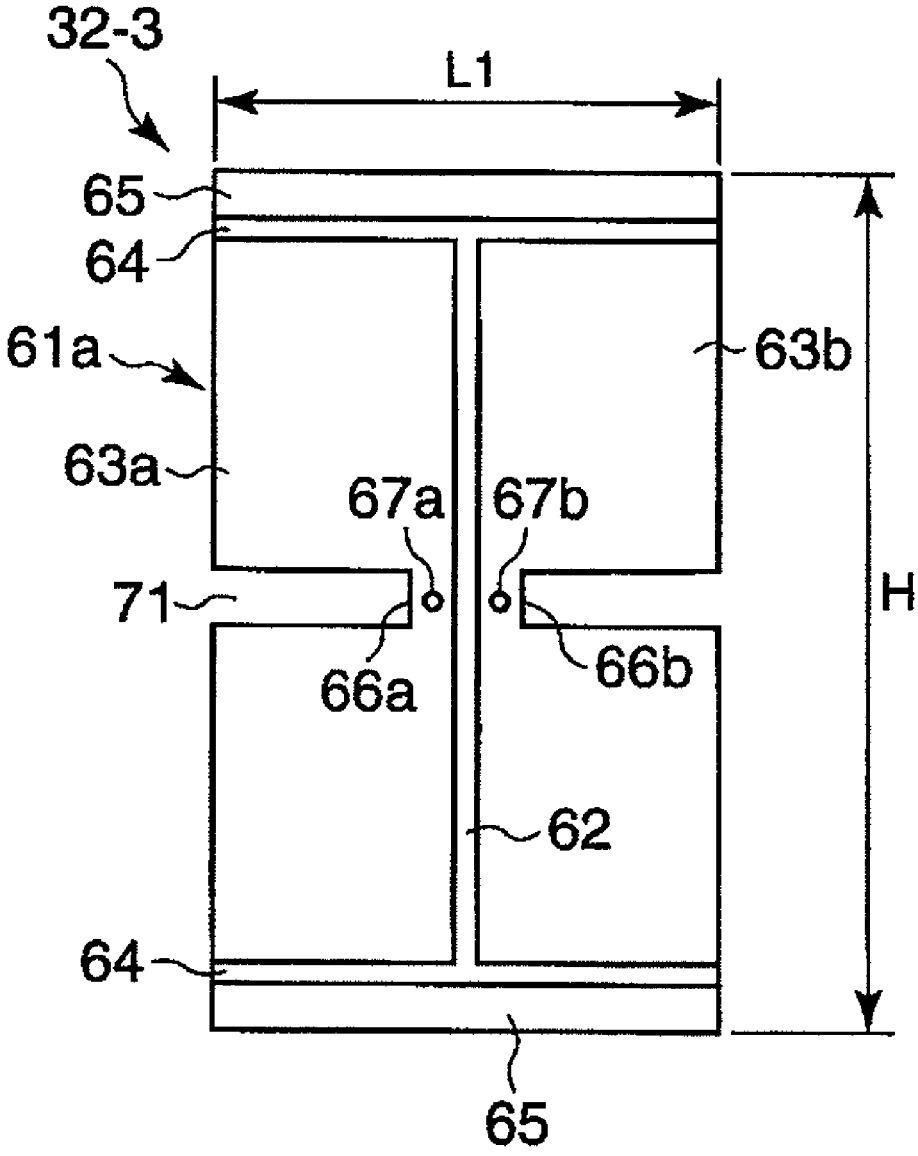
Figure 8C:
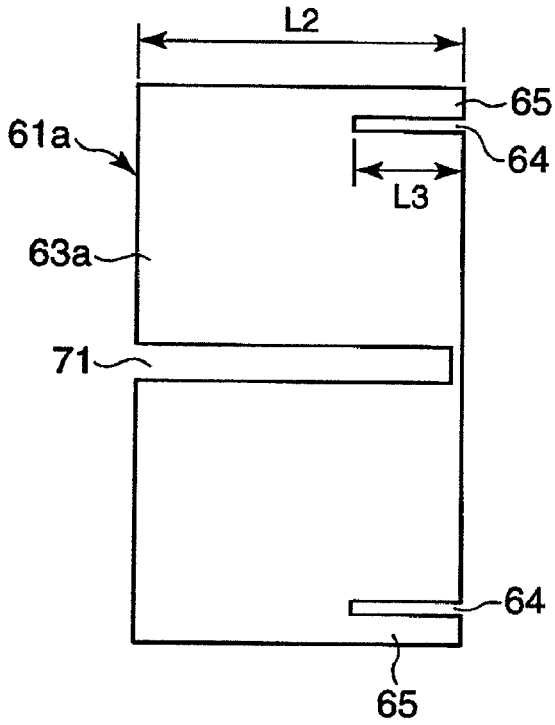

A broadband antenna 32-3 related to a third structural example shown in FIG. 8A to FIG. 8C is arranged as follows: That is, while two pieces of the broadband antenna 32-1 formed in the "U-shaped" form and indicated in FIG. 5A to FIG. 5C is arranged in symmetrical positions along upper and lower directions, these broadband antennas 32-1 are connected with each other by a plate-shaped radiating element 61*a* made of one sheet of a metal plate so as to construct an antenna. In this case, as to the plate-shaped radiating element 61*a*, a height "H" thereof is set to approximately 0.1λ which is two times higher than that of the plate-shaped radiating element 61 shown in FIG. 5A to FIG. 5C; and while the power feeding-purpose projection portions 66*a* and 66*b* formed at a center portion thereof are left, slits 71 along the horizontal direction are provided at right and left sides, so that an upper antenna and a lower antenna are formed. Then, feeding points 67*a* and 67*b* are provided on the power feeding-purpose projection portions 66*a* and 66*b*. Also, second slits 64 are provided parallel to both an upper edge and a lower edge of the plate-shaped radiating element 61*a* so as to construct a folded element 65.

Also, in the plate-shaped radiating element 61*a*, a length of the second slit 64 is made shorter than that of the first structural example, and a length "L3" defined in the side plane of the second slit 64 is set to approximately 0.035λ. Dimensions of respective portions other than the above-described structural portions are identical to those of the broadband antenna 32-1 shown in the first structural example of FIG. 5A to FIG. 5C.

As previously described, the height "H" of the plate-shaped radiating element 61*a* is made approximately two times higher than the height of the plate-shaped radiating element 61 shown in FIG. 5A to FIG. 5C, and such a center power feeding system is employed by which the electric power is supplied from the feeding points 67*a* and 67*b* provided at the center of this plate-shaped radiating element 61*a*. As a result, both the upper antenna and the lower antenna are constructed on the single plate-shaped radiating element 61*a*, so that a stack effect can be achieved.

Fourth Structural Example

Figure 9A:
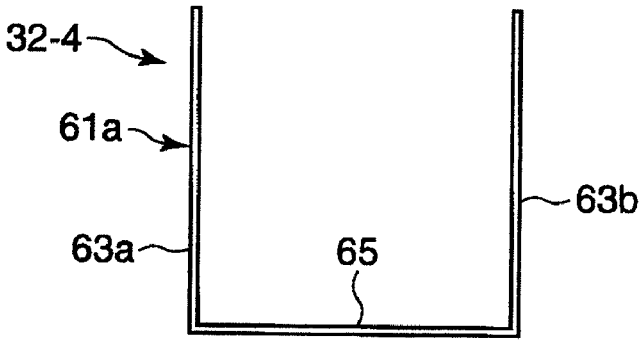
FIG. 9A to FIG. 9C indicate a fourth structural example of a broadband antenna used in the above-described respective embodiment modes, FIG. 9A being a plan view, FIG. 9B being a front view, and FIG. 9C being a side view.
Figure 9B:
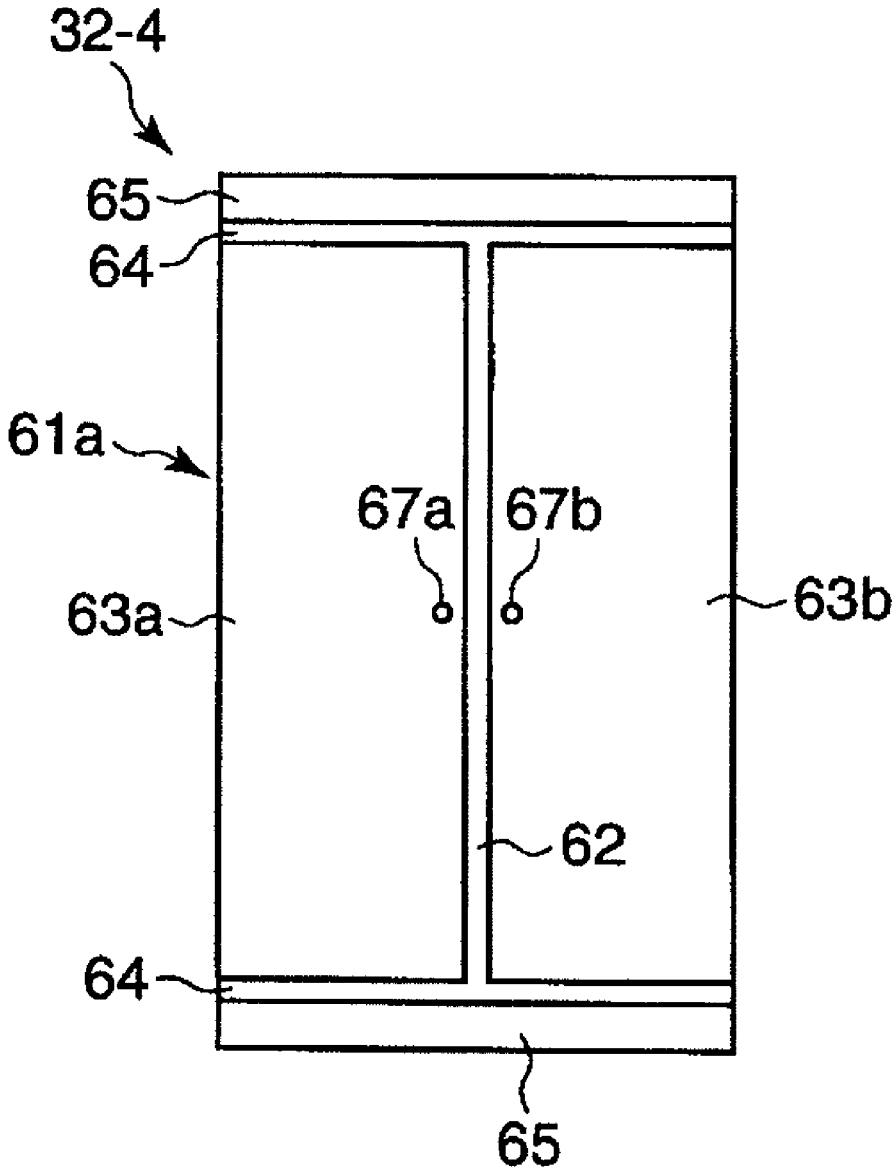
Figure 9C:
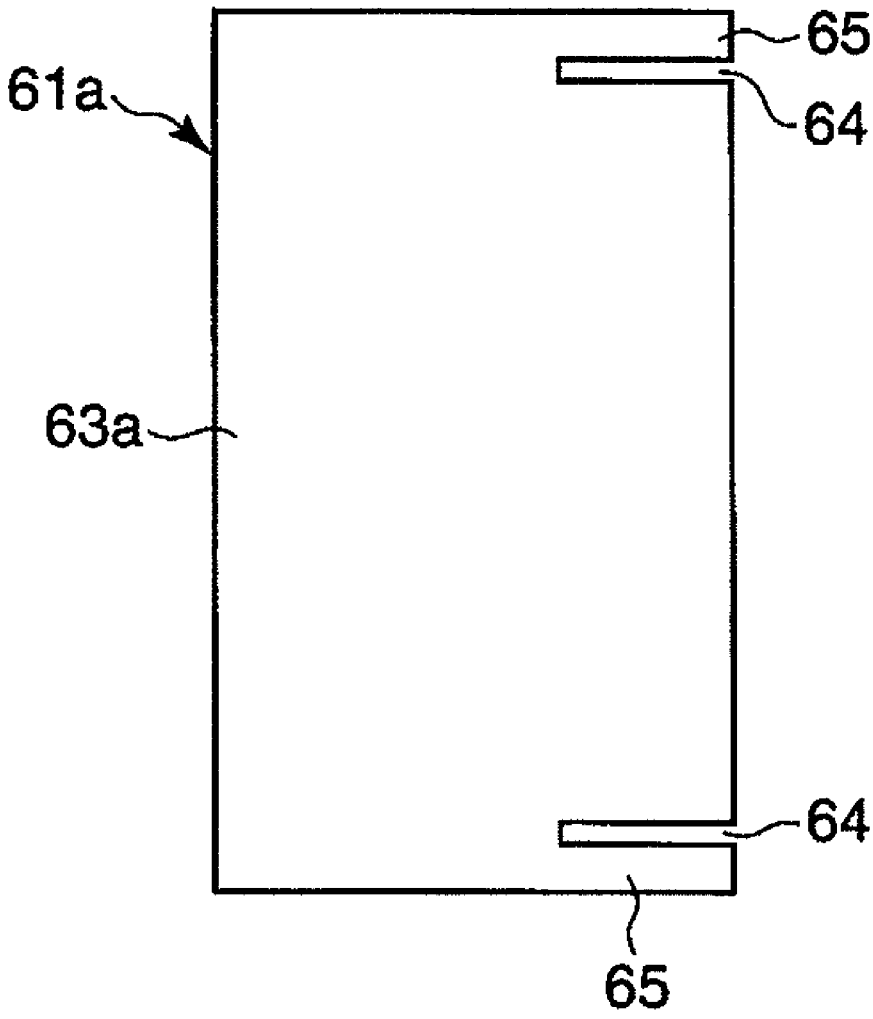

A broadband antenna 32-4 related to a fourth structural example shown in FIG. 9A to FIG. 9C is arranged as follows: That is, in the broadband antenna 32-3 of the third structural example shown in FIG. 8A to FIG. 8C, the slits 71 which are formed at the center of the plate-shaped radiating element 61*a* are omitted. Dimensions of the respective portions of this antenna are similar to the dimensions of the broadband antenna 32-3 shown in FIG. 8A to FIG. 8C.

Fifth Structural Example

Figure 10A:
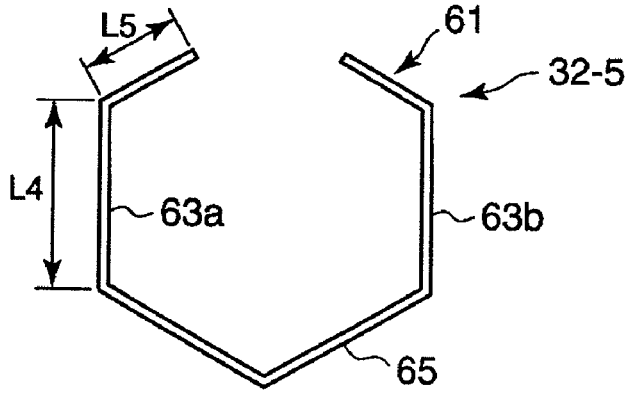
FIG. 10A to FIG. 10C indicate a fifth structural example of a broadband antenna used in the above-described respective embodiment modes, FIG. 10A being a plan view, FIG. 10B being a front view, and FIG. 10C being a side view.
Figure 10B:
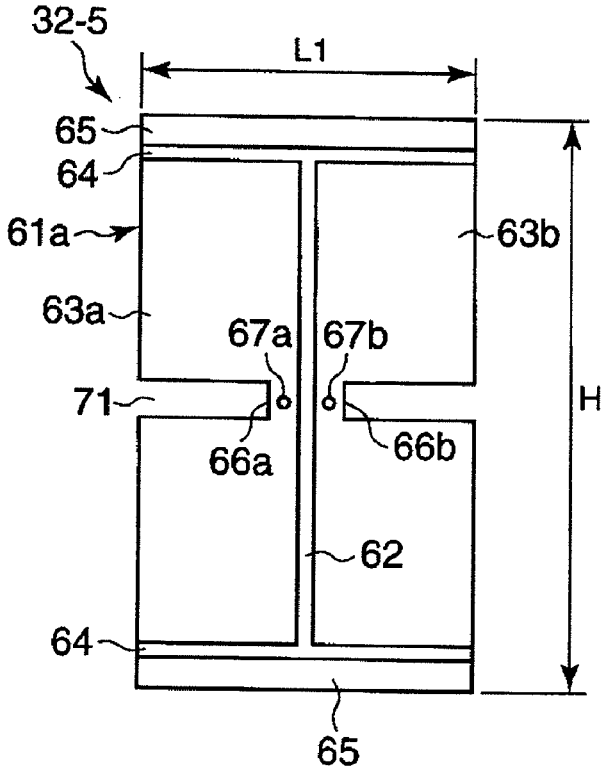
Figure 10C:
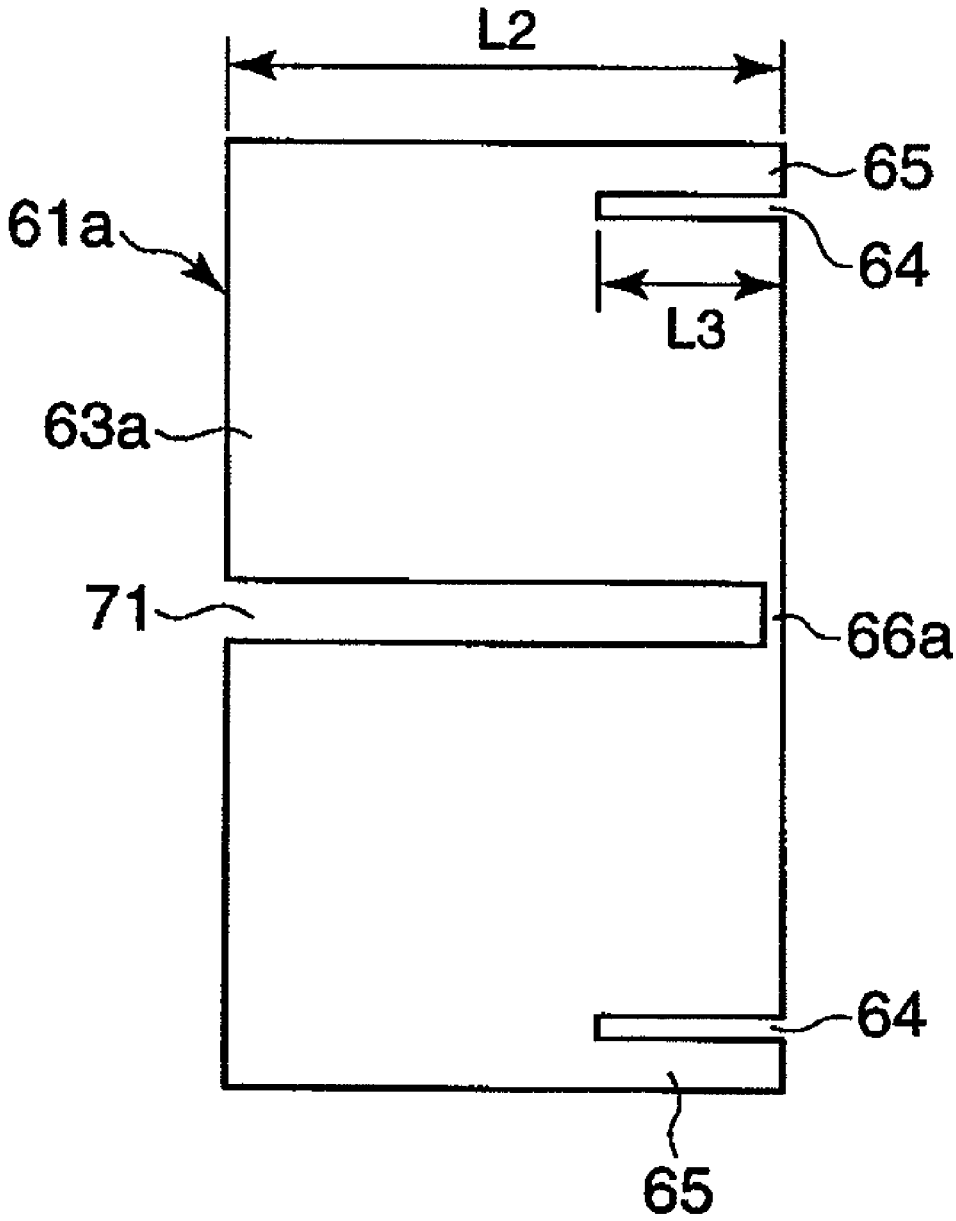

A broadband antenna 32-5 related to a fifth structural example shown in FIG. 10A to FIG. 10C is arranged as follows: That is, in the broadband antenna 32-3 of the third structural example shown in FIG. 8A to FIG. 8C, a plate-shaped radiating element 61*a* is bent in an approximately hexagonal shape which is similar to that of the broadband antenna 32-2 represented in FIG. 7A to FIG. 7C so as to construct the broadband antenna 32-5, while a width "L4" as to a front plane, a right edge, and a left edge of this broadband antenna 32-5 is set to approximately 0.07λ; and a width "L5" of an edge thereof positioned on the side of a rear plane thereof is set to approximately 0.03λ. Since other structures are similar to those of the broadband antenna 32-3 represented in FIG. 8A to FIG. 8C, the same reference numerals will be employed as those for denoting the same structural elements and detailed descriptions thereof will be omitted.

Figure 11:
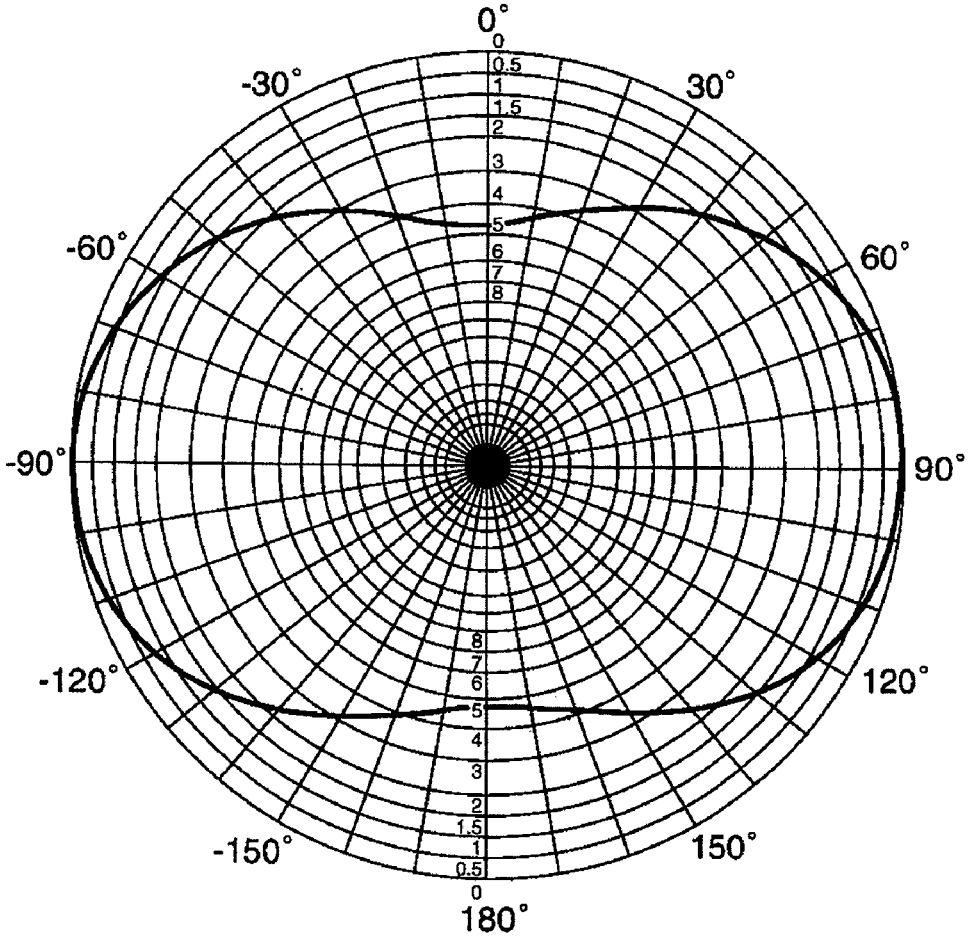
FIG. 11 is a diagram for representing a horizontal plane directivity of a horizontally polarized wave of the broadband antenna related to the above-described fifth structural example at a frequency of 470 MHz.
Figure 12:
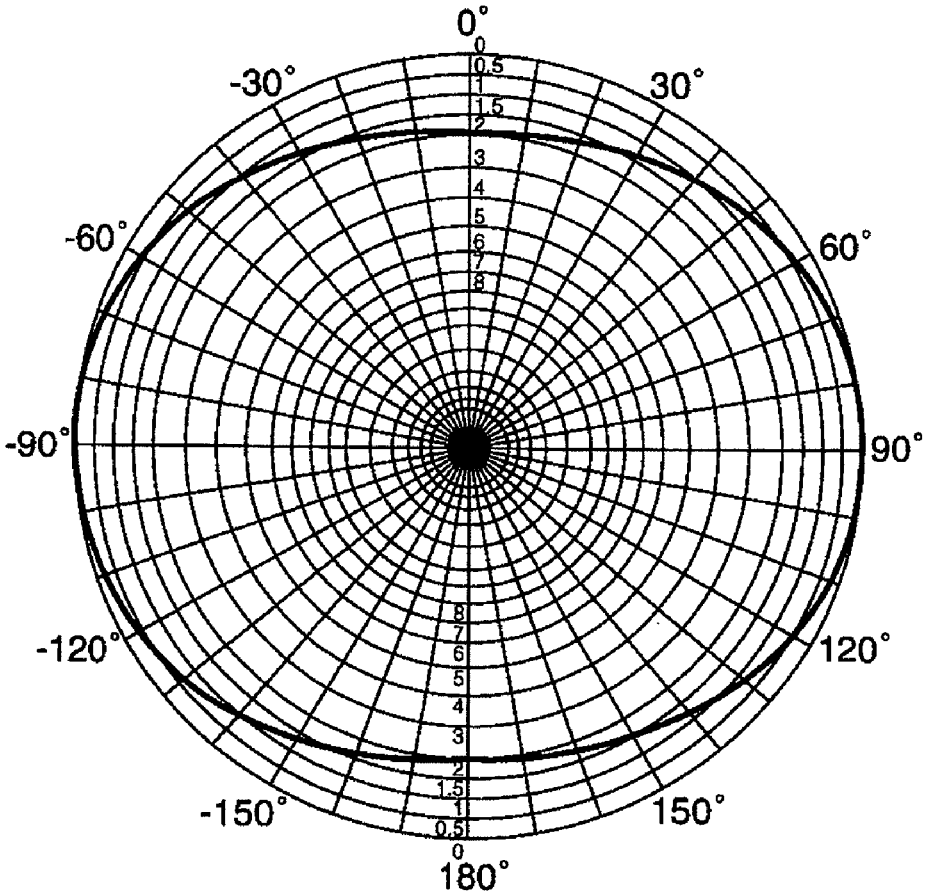
FIG. 12 is a diagram for representing a horizontal plane directivity of a horizontally polarized wave of the broadband antenna related to the above-described fifth structural example at a frequency of 680 MHz.
Figure 13:
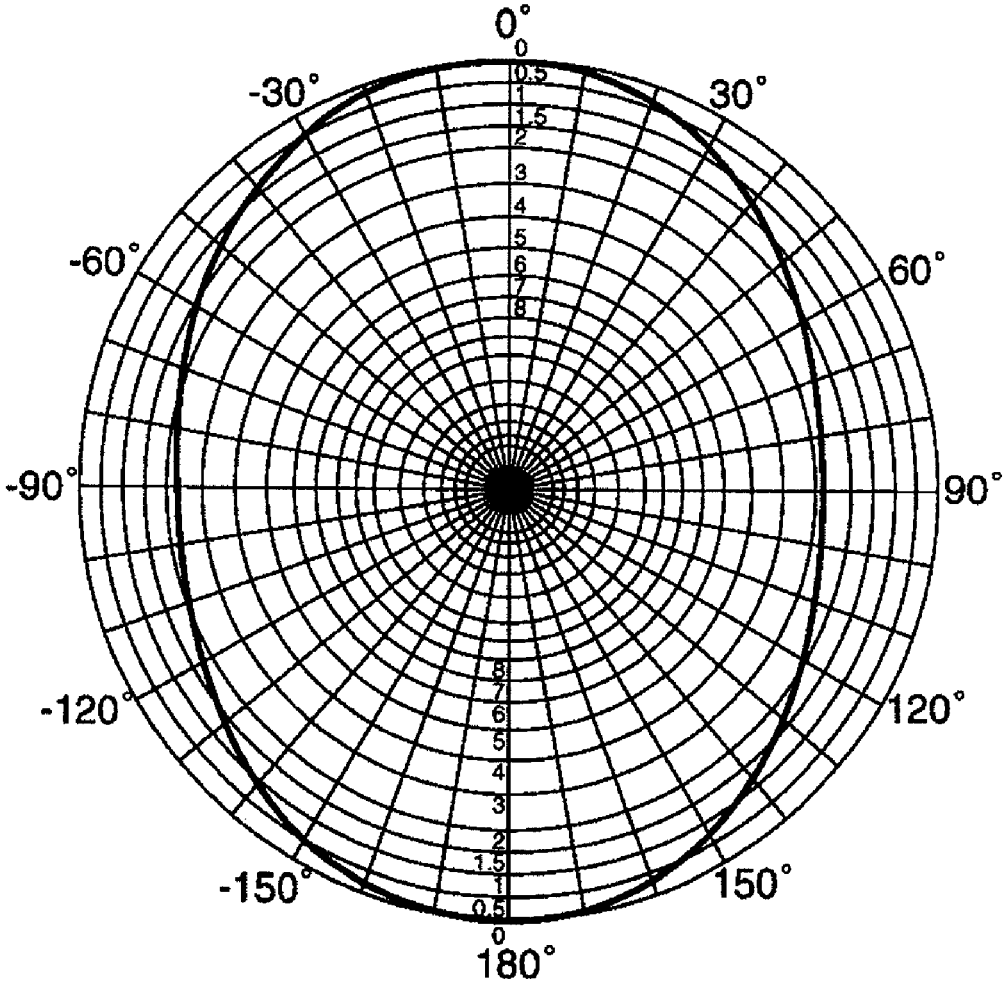
FIG. 13 is a diagram for representing a horizontal plane directivity of a horizontally polarized wave of the broadband antenna related to the above-described fifth structural example at a frequency of 890 MHz.
Figure 14:
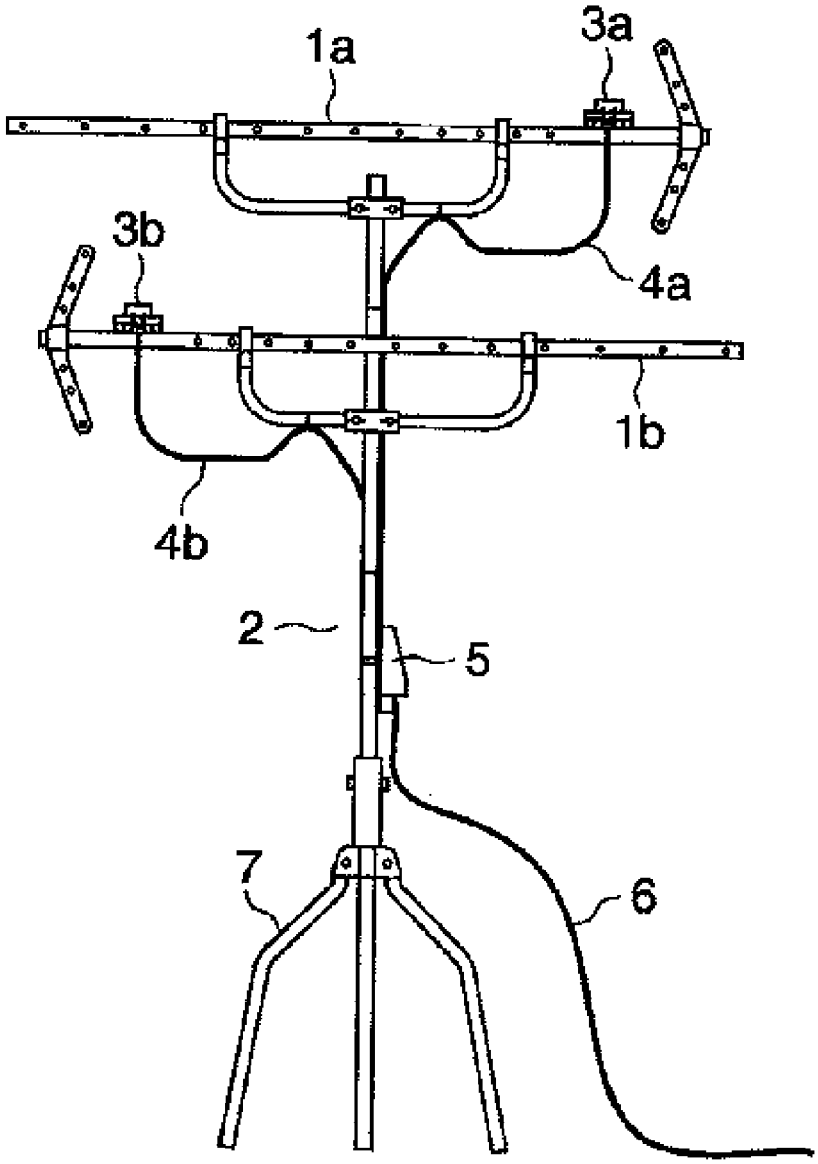
FIG. 14 PRIOR ART
FIG. 14 is a diagram for showing an example in the case that two sets of Yagi-type antennas have been installed in correspondence with electromagnetic waves whose traveling directions are different from each other.

FIG. 11 shows a horizontal directivity of a horizontally polarized wave of the broadband antenna 32-5 related to the above-described fifth structural example at a frequency of 470 MHz; FIG. 12 shows a horizontal directivity of a horizontally polarized wave of the broadband antenna 32-5 related to the above-described fifth structural example at a frequency of 680 MHz; and FIG. 13 shows a horizontal directivity of a horizontally polarized wave of the broadband antenna 32-5 related to the above-described fifth structural example at a frequency of 890 MHz.

Since the broadband antenna 32-5 is used, the horizontal plane directivity thereof may be made as an omnidirectional characteristic. Also, in the broadband antennas 32-1 to 32-4 shown in the first structural example to the fourth structural example, the horizontal plane directivities thereof may be made an omnidirectional characteristics.

It should also be noted that in the broadcast antenna 32-5 shown in the fifth structural example, similar to the broadband antenna 32-4 of the fourth structural example, the slits 71 formed in the center portion of the plate-shaped radiating element 61*a* may be alternatively omitted.

Also, although the second structural example and the fifth structural example is described such a case that the plate-shaped radiating elements 61 and 61*a* are bent in the hexagonal shapes so as to construct the broadband antennas 32-2 and 32-5, these plate-shaped radiating elements 61 and 61*a* may be alternatively bent in such polygonal shapes as octagonal shapes.

In the above-described respective embodiment modes, such a case is exemplified in which the broadband antenna 32-5 related to the fifth structural example shown in FIG. 10A to FIG. 10C is used as the broadband antennas 32*a* and 32*b*. As apparent from the foregoing descriptions, the broadband antennas 32-1 to 32-4 related to the first structural example to the fourth structural example may be alternatively used.

In the broadband antennas 32-1 to 32-5 related to the first structural example through the fifth structural example, the width L1 of the front plane and the width L2 of the side plane are approximately 0.12λ, and the maximum length of the polarization plane is approximately 0.16λ. As a consequence, the lengths of the antenna covers 31*a* and 31*b* on the side of the polarization planes in the respective embodiment modes, namely, the lateral width "da" thereof may be set to approximately 0.17λ, as shown in FIG. 1.

As a result, in the indoor-purpose antennas 20A and 20B, and in the indoor and outdoor commonly-used antenna 20D represented in each of these embodiment modes, the diameters of the bases 21, 21*a*, 21*c* designed for the indoor antennas may be set to be small, approximately 0.22λ (approximately 140 mm).

As previously explained, the setting spaces for the indoor-purpose antennas 20A and 20B related to the first and second embodiment modes, and also, the setting space in the case that the indoor and outdoor commonly-used antenna 20D related to the third embodiment mode is used as the indoor-purpose antenna are very small, as compared with the setting space of the conventional antenna. As a result, while the freedom degree of the setting spaces becomes large, the antennas 20A, 20B, 20D can be readily set even in a narrow place.

Also, the present invention is not directly limited only to the above-described embodiment modes, but may be alternatively embodied by modifying the structural elements at embodying stages without departing from the gist of the present invention.

The invention claimed is:

1. An antenna, comprising:

a plate-shaped radiating element, formed by bending a metal plate having a substantially rectangular shape so as to have a shape having at least three planes each extending in a first direction between a first edge of the plate-shaped radiating element and a second edge of the plate-shaped radiating element, the plate-shaped radiating element having a third edge and a fourth edge in a second direction perpendicular to the first direction;

a first slit, provided in the first direction between a portion in the vicinity of the first edge and a portion in the vicinity of the second edge through a center point of the plate-shaped radiating element, and forming plate-shaped dipole elements on both sides of the first slit;

a second slit, provided in the second direction, and forming a first folded element on a side of the first edge;

a third slit, provided in the second direction, and forming a second folded element on a side of the second edge; and feeding points, provided on both sides of the first slit, wherein the plate-shaped dipole elements are greater than the first and second folded elements in width in the first direction.

2. The antenna as claimed in claim 1, further comprising:

a cover, adapted to cover the antenna member; wherein:

a longitudinal length of the cover is longer than a diametrical length of the cover on a side parallel to a polarization plane of the electromagnetic waves received by the antenna member.

3. The antenna as claimed in claim 2, further comprising:

a base to be attached to the cover.

4. The antenna as claimed in claim 2, further comprising:

an output member, operable to output a signal based on the electromagnetic waves received by the antenna member.

5. The antenna as claimed in claim 2, further comprising:

an outdoor setting-purpose attaching member which is attached to the cover.

6. The antenna as claimed in claim 2, further comprising:

a supporting member, integrally or detachably provided with the cover, and selectively attachable to one of an indoor setting-purpose base and an outdoor setting-purpose attaching member.

* * * * *